US009669529B2

(12) United States Patent
Ishizawa et al.

(10) Patent No.: US 9,669,529 B2
(45) Date of Patent: Jun. 6, 2017

(54) DRIVING TOOL WITH PUSH LEVER CONFIGURED TO CONTACT HOUSING

(71) Applicant: HITACHI KOKI CO., LTD., Tokyo (JP)

(72) Inventors: Yoshinori Ishizawa, Hitachinaka (JP); Haruhiko Oouchi, Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 396 days.

(21) Appl. No.: 14/458,530

(22) Filed: Aug. 13, 2014

(65) Prior Publication Data

US 2015/0090758 A1 Apr. 2, 2015

(30) Foreign Application Priority Data

Sep. 27, 2013 (JP) ..... 2013-201968

(51) Int. Cl.
*B25C 1/08* (2006.01)
*B25C 1/00* (2006.01)

(52) U.S. Cl.
CPC ..... *B25C 1/008* (2013.01)

(58) Field of Classification Search
CPC .. B25C 1/00; B25C 1/04; B25C 1/043; B25C 1/005; B25C 1/008
USPC ..... 227/8, 10, 142, 119, 120, 148
See application file for complete search history.

(56) References Cited

U.S. PATENT DOCUMENTS 3,762,620 A * 10/1973 Geist ..... B25C 1/008 227/8
4,260,092 A * 4/1981 Austin ..... B25C 1/043 227/8
4,346,831 A * 8/1982 Haytayan ..... B25C 1/001 227/130
4,630,766 A * 12/1986 Steeves ..... B25B 31/00 227/113

(Continued)

FOREIGN PATENT DOCUMENTS

JP 59-156782 U 10/1984
JP 60-190580 U 12/1985

(Continued)

OTHER PUBLICATIONS

Japan Patent Office Notification of Reason for Refusal for patent application JP2013-201968 (Oct. 18, 2016).

*Primary Examiner* — Scott A. Smith
(74) *Attorney, Agent, or Firm* — Kilpatrick Townsend & Stockton LLP

(57) ABSTRACT

In a driving tool, a push lever plunger is moved upward by a push lever unit when the push lever unit is disposed at an uppermost position. The push lever unit includes a first protruding part and a second protruding part. The first protruding part is configured to contact a first contact part of a housing when the push lever unit is disposed at the uppermost position. The second protruding part is configured to contact a second contact part of the housing when the push lever unit is disposed at the uppermost position. A compressed air control unit, the second protruding part, and (Continued)

an ejection channel are disposed within an imaginary plane extending in an approximate vertical direction. The compressed air control unit is disposed on a side opposite to the second protruding part with respect to the ejection channel in a horizontal direction.

6 Claims, 5 Drawing Sheets

(56) References Cited

U.S. PATENT DOCUMENTS 5,551,620 A * 9/1996 Vallee ..... B25C 1/043 227/120
5,911,351 A * 6/1999 White ..... B25C 1/047 173/211
6,045,024 A * 4/2000 Phillips ..... B25C 1/08 227//10
6,199,739 B1 * 3/2001 Mukoyama ..... B25C 1/008 227/120
6,763,992 B2 7/2004 Hirai
7,255,256 B2 * 8/2007 McGee ..... B25C 1/188 227/119
7,431,187 B2 10/2008 Tachihara et al.
7,490,747 B2 * 2/2009 Kitagawa ..... B25C 1/008 227/119
8,336,748 B2 * 12/2012 Hlinka ..... B25C 1/008 227/131
2010/0012700 A1 * 1/2010 Perron ..... B25C 1/008 227/8

FOREIGN PATENT DOCUMENTS

JP 04-079070 U 7/1992
JP 2003-074278 A 3/2003
JP 2003-136429 A 5/2003
JP 2004-154870 A 6/2004
JP 2004-279354 A 10/2004
JP 2004-351523 A 12/2004
JP 2012-108573 A 6/2012
JP 2012-111017 A 6/2012

* cited by examiner

DRIVING TOOL WITH PUSH LEVER CONFIGURED TO CONTACT HOUSING

CROSS REFERENCE TO RELATED APPLICATION

This application claims priority from Japanese Patent Application No. 2013-201968 filed Sep. 27, 2013. The entire content of the priority application is incorporated herein by reference.

TECHNICAL FIELD

The present invention relates to a driving tool, such as a nail-driving tool, that uses compressed air to drive fasteners into a workpiece.

BACKGROUND

Nail-driving tools for driving a nail into a workpiece using compressed air are known in the art. Some nail-driving tools are designed to perform nail-driving operations in rapid succession. Japanese unexamined patent application publication No. 2012-111017 shows this type of nail-driving tool.

SUMMARY

A conceivable nail-driving tool has a push lever and a push lever plunger that is turned on when the push lever moves upward. However, the push lever can be tilted due to loose or worn of the push lever. The tilt of the push lever causes a problem that the push lever cannot contact the push lever plunger while the push lever is moved upward. When the push lever becomes loose or worn and cannot properly turn on the push lever plunger, the nail-driving tool may not function properly. In other words, it is difficult to produce a driving tool that can continue to be used after the push lever becomes loose or worn.

Further, the push lever is generally constructed of a plurality of parts that are assembled together. These components themselves may be loose-fitting due to variation in their dimensions and the means for connecting them together. Such looseness may also lead to the tilt of the push lever.

The push lever slides also tend to wear as the push lever is repeatedly reciprocated vertically, and this wear may further increase the looseness of its components. The push lever may also deform over time. Thus, the above problem can become particularly pronounced when the nail-driving tool has endured much use.

In view of the foregoing, it is an object of the present invention to provide a driving tool with a structure that resolves the issues described above.

In order to attain the above and other objects, the invention provides a driving tool that may include a housing, a push lever unit, a compressed air control unit, and a driving unit. The housing may have the nose fixed to the housing and provided with an ejection channel for guiding a fastener. The ejection channel may be defined inside the nose and extend in a vertical direction. The push lever unit may be configured to move between a lowermost position and an uppermost position in the vertical direction relative to the housing. The compressed air control unit may be configured to control supply of compressed air and include a push lever plunger. The push lever plunger may be configured to move upward and downward. The push lever plunger may be moved upward by the push lever unit when the push lever unit is disposed at the uppermost position. The driving unit may be configured to drive the fastener into a workpiece upon receiving the compressed air that has been supplied by the compressed air control unit. The housing may include a first contact part and a second contact part. The push lever unit may include a first protruding part and a second protruding part. The first protruding part may be configured to contact the first contact part when the push lever unit is disposed at the uppermost position. The second protruding part may be configured to contact the second contact part when the push lever unit is disposed at the uppermost position. The compressed air control unit, the second protruding part, and the ejection channel may be disposed within an imaginary plane extending in an approximate vertical direction. The compressed air control unit may be disposed on a side opposite to the second protruding part with respect to the ejection channel in a horizontal direction.

According to another aspect, the present invention provides a driving tool that may include a housing, a nose, a driver blade, a drive mechanism, a trigger lever, and a push lever unit. The housing may have the nose fixed to the housing and provided with an ejection channel for guiding a fastener. The ejection channel may be disposed inside the nose and extending in a vertical direction. The nose may have a lower end part. The driver blade may be configured to reciprocate in the ejection channel and to drive the fastener. The drive mechanism may be disposed in the housing and be configured to drive the driver blade. The trigger lever may be provided on the housing. The push lever unit may be configured to move upward and downward in the vertical direction relative to the nose. The push lever unit may have: a lower end portion disposed at a position closer to the lower end part of the nose than to the trigger lever; an upper end portion disposed at a position closer to the trigger lever than to the lower end part of the nose; and a contact part configured to contact the housing. The contact part may be disposed on a side opposite to the upper end portion with respect to the ejection channel in a horizontal direction. The lower end portion, the upper end portion, and the contact part may be disposed in a single imaginary plane.

The terms "vertical", "horizontal", "lowermost", "uppermost", "upward", "downward", "upper", and "lower" are used assuming that the nose is positioned below the housing and that the driver blade extends in the vertical direction.

BRIEF DESCRIPTION OF THE DRAWINGS

The particular features and advantages of the invention as well as other objects will become apparent from the following description taken in connection with the accompanying drawings, in which.

DETAILED DESCRIPTION

Figure 1:
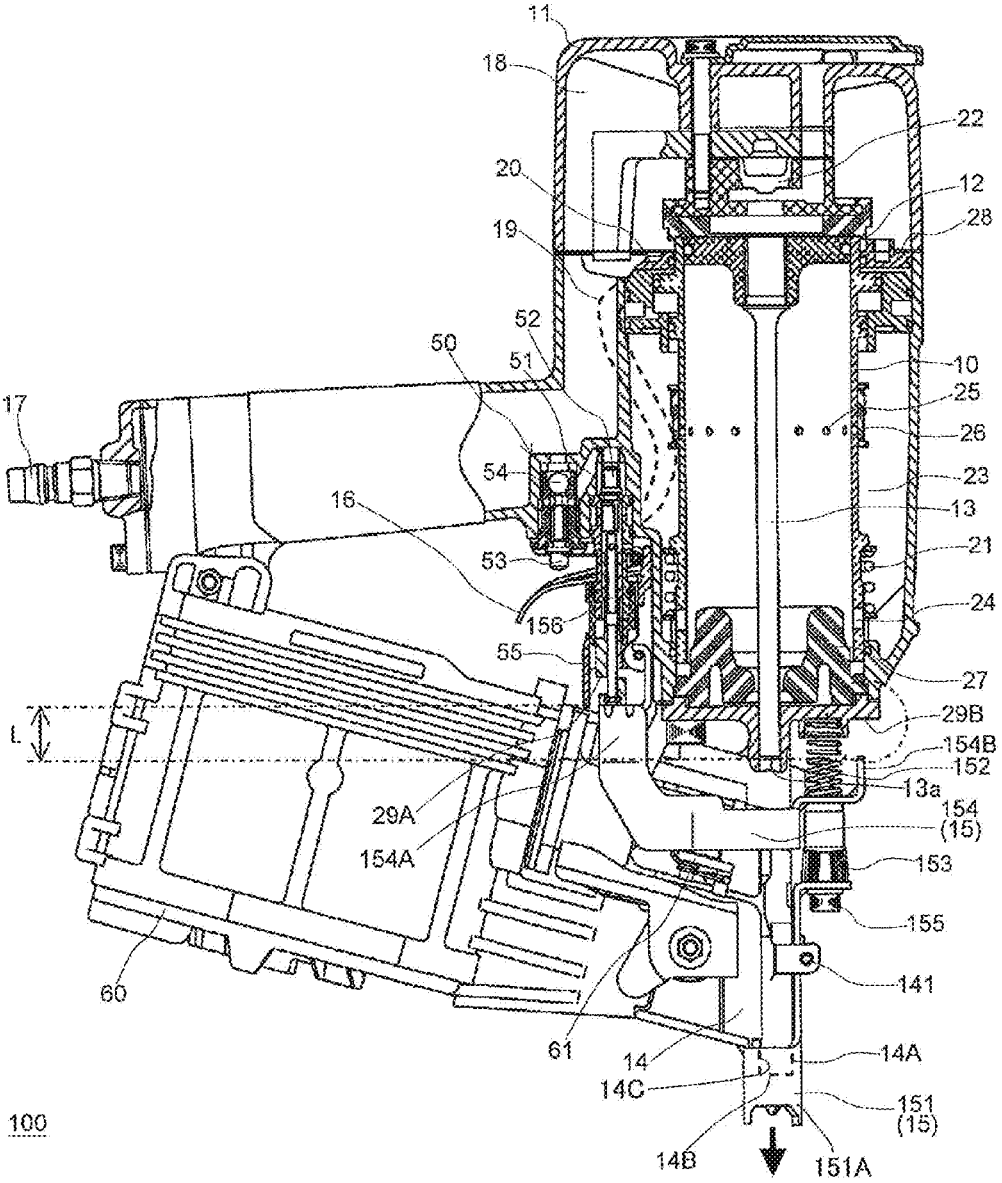
FIG. 1 is a cross-sectional view showing a structure of a driving tool according to an embodiment of the present invention.

A driving tool according to an embodiment of the invention will be described while referring to FIGS. 1 to 4. The terms "upward", "downward", "upper", "lower", "above", "below", "right", "left" and the like will be used throughout the description assuming that the driving tool is disposed in an orientation in which it is intended to be used. In use, the driving tool is disposed as shown in FIG. 1.

Figure 2:
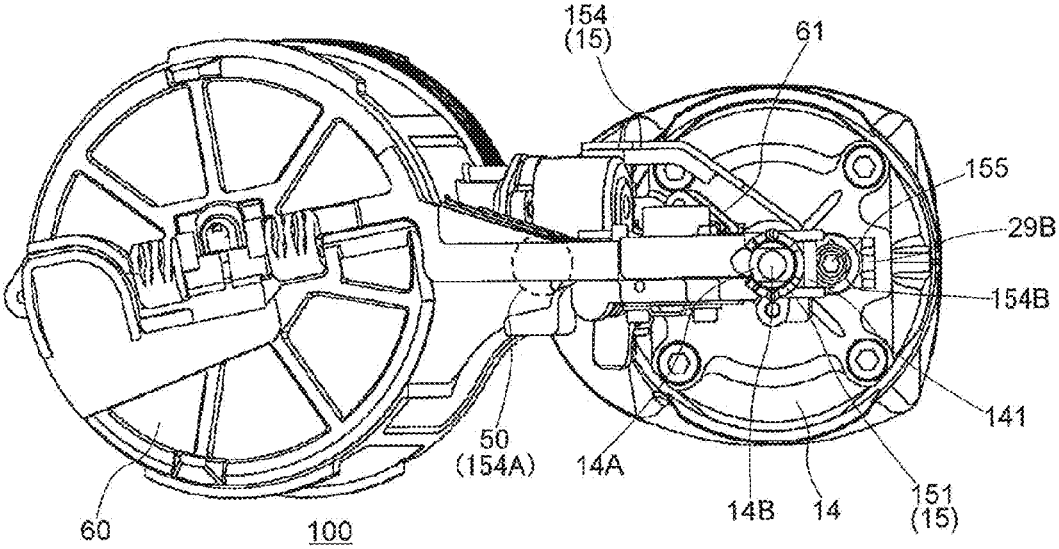
FIG. 2 is a bottom view of the driving tool shown in FIG. 1.

A nail-driving tool 100 will be described as an example of a driving tool. FIG. 1 is a cross-sectional view showing the structure of the nail-driving tool 100, and FIG. 2 is a bottom view of the nail-driving tool 100. The nail-driving tool 100 is configured to drive nails downward in FIG. 1.

The nail-driving tool 100 includes a housing 11, a cylinder 10, a piston 12, a driver blade 13, a push lever unit 15, a trigger lever 16, a main valve 28, a compressed air control unit 50, a magazine 60, and a feeder 61. The housing 11 is the body of the nail-driving tool 100 and is configured to support and cover all internal components.

The housing 11 defines a storage chamber 18 configured to store high-pressure compressed air. The storage chamber 18 is provided above the cylinder 10. An air plug 17 is connected to the storage chamber 18 by an air hose (not shown). The pressure compressed air is introduced through the air plug 17 and air hose to the storage chamber 18.

The cylinder 10 is disposed inside the housing 11 and has a central axis extending in a vertical direction. The cylinder 10 is configured to move up and down within the housing 11. A spring 21 is wound about the outer circumferential surface of the cylinder 10. The spring 21 has one end fixed to the housing 11 and another end fixed to the cylinder 10. The spring 21 urges the cylinder 10 upward. An air channel 24 is formed in the lower side of the cylinder 10 to allow communication between a return chamber 23 and the lower chamber (a space formed beneath the piston 12 in the cylinder 10). The return chamber 23 is formed around the circumference of the cylinder 10 in the housing 11.

A plurality of air holes 25 is formed in the cylinder 10 at a prescribed height. The air holes 25 are at a position higher than the air channel 24 and are formed at intervals around the circumference of the cylinder 10. The air holes 25 allow communication between the interior of the cylinder 10 and the return chamber 23. Check valves 26 are respectively coupled to the air holes 25. The check valves 26 allow air to flow only in one direction from the interior of the cylinder 10 into the return chamber 23.

The piston 12 is provided inside the cylinder 10 and is capable of sliding vertically therein. The piston 12 divides the space inside the cylinder 10 into an upper chamber and the lower chamber. The upper chamber is formed above the piston 12. The lower chamber is formed below the piston 12. The piston 12 is configured to move rapidly downward when the compressed air is supplied and injected into a space defined above the piston 12 (the upper chamber) in the cylinder 10. The piston 12 moves vertically inside the cylinder 10 over a range greater than the moving range of the cylinder 10. In an initial state, the cylinder 10 is in its upper position and the piston 12 is in its top dead center.

The driver blade 13 is provided on the bottom of the piston 12 and configured to reciprocate in an ejection channel 14C to drive a nail. The driver blade 13 is integrally formed with the piston 12 and extends vertically downward therefrom. The lower end of the driver blade 13 constitutes a blade tip 13*a*. The blade tip 13*a* is configured to contact the head of a nail when the piston 12 is moved downward by the pressure of compressed air and drives the nail downward with a strong impact force. In other words, the driver blade 13 is configured to drive the nail into the workpiece upon receiving the compressed air supplied from the compressed air control unit 50. The driver blade 13 serves as an example of a driving unit.

The housing 11 further includes the nose 14. Specifically, the nose 14 is fixed to the bottom of a main body of the housing 11. The nose 14 has a narrow tip portion called a nose tip 14A. The nose tip 14A serves as an example of a lower end part of the nose. An ejection hole 14B is formed in the lower end of the nose tip 14A. The ejection channel 14C for guiding a fastener such as the nail is defined inside the nose tip 14A and extends in the vertical direction. An anchoring pin 141 is fixed to the nose tip 14A side of the nose 14.

The blade tip 13*a* is configured to drive nails downward precisely and unwaveringly along the nose 14 in the vertical direction. Specifically, the driver blade 13 moves vertically downward within the ejection channel 14C in the nose tip 14A to impact the head of the nail therein. As a result, the nail is driven reliably downward in the ejection channel 14C and is ejected through the ejection hole 14B formed in the bottom of the nose tip 14A.

A piston bumper 27 is provided in the bottom of the cylinder 10 near the bottom dead center of the piston 12. The piston bumper 27 is formed of an elastic material and functions to absorb the residual energy possessed by the piston 12 after the piston 12 strikes the nail.

An exhaust valve 22 is provided above the piston 12 and in the housing 11. The exhaust value 22 is configured to allow and block passage between the upper chamber (the space above the piston 12 in the cylinder 10) and outside air, and configured to exhaust air from the upper chamber.

The housing 11 further defines a main valve chamber 20 in which a main valve 28 is disposed. The main valve chamber 20 is formed around the top portion of the cylinder 10. The main value 28 is configured to operate in association with a trigger valve 54 described later. An air channel 19 is provided for introducing air from the storage chamber 18 into the main valve chamber 20.

The trigger lever 16 is provided on the housing 11. More specifically, the trigger lever 16 is mounted in the housing 11 through a shaft (not shown) provided on its right end in FIG. 1. The trigger lever 16 is capable of rotating about this shaft.

The magazine 60 is disposed on the left side of the nose 14 and configured to hold nails used in the nail-driving operations. The feeder 61 is configured to supply the nails from the magazine 60 into the ejection channel 14C with the head of the nail on top.

The push lever unit 15 is mounted around the nose tip 14A. The push lever unit 15 is configured to move between a lowermost position and an uppermost position in the vertical direction relative to the housing 11 (the nose 14) while sliding over the outer surface of the nose tip 14A.

The push lever unit 15 is configured of a plurality of members that have been assembled together, including a push lever body 151, a push lever spring 152, an adjuster 153, a push lever 154, and a bolt 155.

The push lever body 151 has a general cylindrical shape. A lower end portion 151A of the push lever body 151 covers the nose tip 14A. The lower end portion 151A is disposed at a position closer to the nose tip 14A than to the trigger lever 16. The push lever body 151 is configured to slide over the side surface of the nose tip 14A. The push lever body 151 is sandwiched between the anchoring pin 141 and the side surface of the nose tip 14A with slight gaps formed between these components so that the push lever body 151 can slide vertically over the side surface of the nose tip 14A. The push lever unit 15 (push lever body 151) moves upward along the nose 14 (nose tip 14A) when the operator places the lower end of the nose tip 14A in contact with a workpiece.

The push lever spring 152 is configured to urge the push lever unit 15 downward so that the lower end of the lower end portion 151A protrudes farther downward than the lower end of the nose tip 14A when an external force is not being applied to the lower end of the push lever body 151 (when the bottom edge of the push lever body 151 is not in contact with a workpiece or the like).

The push lever 154 is fastened to the push lever body 151 by the bolt 155. The push lever 154 is secured in place by the bolt 155. The upper left portion of the push lever 154 in FIG. 1 extends toward the compressed air control unit 50, with the upper end of the push lever 154 positioned near the trigger lever 16. The adjuster 153 is interposed between the head of the bolt 155 and the push lever 154. The top inner portion of the adjuster 153 has threading so as to be screwed together with the push lever 154. By turning the adjuster 153, an operator can adjust the relative vertical positions of the push lever body 151 and the push lever 154 in order to adjust the depth at which nails are driven.

The push lever 154 has a first protruding part 154A on the left side in FIG. 1, and a second protruding part 154B on the right side in FIG. 1. The first protruding part 154A protrudes upward in a position for contacting a first contact part 29A described later. The second protruding part 154B protrudes upward in a position for contacting a second contact part 29B described later. The first protruding part 154A is disposed at a position closer to the trigger lever 16 to the nose tip 14A. The first protruding part 154A serves as an example of an upper end portion of the push lever unit. The second protruding part 154B is configured to contact the second contact part 29B before the first protruding part 154A contacts the first contact part 29B while the push lever unit 15 moves from the lower most position to the uppermost position. The second protruding part 154B serves as an example of an contact part of the push lever unit.

Figure 3:
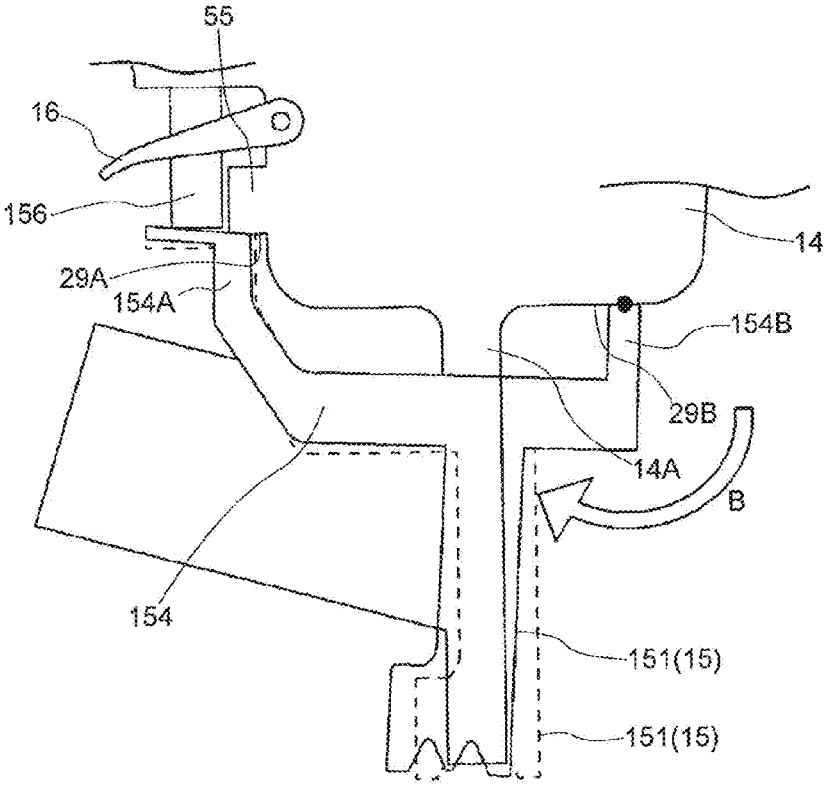
FIG. 3 schematically illustrates the structure of a push lever unit of the driving tool shown in FIG. 1.

FIG. 3 schematically illustrates the structure of the push lever unit 15 of FIG. 1. In FIG. 3, the push lever unit 15 is shown as a single integral unit. Note that, although shapes of a valve guard 55 (described later), a rod 156 (described later), and the push lever unit 15 shown in FIG. 3 are depicted as shapes different from those depicted in FIG. 1, the valve guard 55, the rod 156, and the push lever unit 15 shown in FIG. 3 indicates those shown in FIG. 1, respectively.

As shown in FIG. 3, the first protruding part 154A and the second protruding part 154B are on opposing sides of the push lever body 151. In other words, the second protruding part 154B is disposed on a side opposite to the first protruding part 154A with respect to the ejection channel 14C in the horizontal direction. The first protruding part 154A and the second protruding part 154B are positioned to contact the housing 11 when the push lever unit 15 moves upward.

As shown in FIG. 1, the housing 11 further includes a valve guard 55 fixed to the compressed air control unit 50. The valve guard 55 is configured to protect the compressed air control unit 50.

The compressed air control unit 50 is provided in the housing 11 along one side of the cylinder 10. Specifically, the compressed air control unit 50 is provided on one side of the housing 11 that is closer to the magazine 60. The compressed air control unit 50 is configured to control the supply of compressed air from the storage chamber 18 to the upper chamber (the space formed above the piston 12 in the cylinder 10). In other words, the compressed air control unit 50 is configured to supply compressed air into the main valve chamber 20. As shown in FIG. 2, the compressed air control unit 50 is disposed at a position apart from the nose tip 14A in the direction toward the magazine 60 (the left side of the nose tip 14A along the horizontal direction in FIG. 2).

The compressed air control unit 50 is hidden by the feeder 61 and the like in FIG. 2. The push lever 154 extends from the end anchored by the bolt 155 toward the upper left side in FIG. 2 (on the near left side in FIG. 1). From the left end of this extended portion, the push lever 154 extends downward in FIG. 2 (toward the far side in FIG. 1) in the region hidden by the feeder 61 and the like. This latter portion of the push lever 154 constitutes the first protruding part 154A.

The compressed air control unit 50 has an air channel 51 formed therein. The air channel 51 is configured to communicate with the air channel 19 and with the storage chamber 18. Communication is established between the air channel 51 and air channel 19 through action (1) for moving the push lever unit 15 upward.

The compressed air control unit 50 also includes a push lever plunger 52, a trigger plunger 53 and a trigger valve 54.

The trigger plunger 53 is disposed on the left side of the push lever plunger 52 in FIG. 1 so as to be capable of moving upward and downward. The trigger valve 54 is positioned above the trigger plunger 53.

The push lever plunger 52 is configured to move upward and downward. When the push lever plunger 52 is moved upward, a push lever valve (not shown) is exposed, allowing communication between the air channel 51 and the air channel 19. More specifically, the rod 156 is provided on the top of the push lever 154 near the left side in FIG. 1 and extends upward therefrom. When the push lever unit 15 (push lever 154) moves upward, the rod 156 contacts the push lever plunger 52 and pushes the push lever plunger 52 upward. In other words, the push lever plunger 52 is moved upward via the road 156 by the push lever unit 15 when the push lever unit 15 is disposed at the uppermost position. Displacing the push lever plunger 52 opens the push lever valve to establish communication in the compressed air control unit 50 between the air channel 51 and the air plug 17. Hereinafter, this operation will be referred to as "turning on the push lever plunger 52."

On the other hand, communication between the air channel 51 and the storage chamber 18 is established through action (2) in which the operator pulls the trigger lever 16. When the operator pulls and operates the trigger lever 16 upward, the trigger lever 16 rotates clockwise in FIG. 1, pushing the trigger plunger 53 upward. The trigger plunger 53 in turn pushes the trigger valve 54 upward. When pushed upward, the trigger valve 54 is opened, allowing communication between the air channel 51 and the storage chamber 18. Thus, the operation of pulling the trigger lever 16 establishes communication between the air channel 51 and storage chamber 18.

With the above-described constructions, the nail-driving tool 100 is configured to execute a nail-driving operation when the operator pulls on the trigger lever 16 while the lower end of the nose tip 14A is in contact with a workpiece or the like. In other words, the compressed air control unit 50 supplies the compressed air and the driving blade 13 drives the nail into the workpiece using the compressed air that has been supplied. Nail-driving operations can be performed at a rate of approximately three per second, requiring the piston 12 and push lever unit 15 to move rapidly up and down. During this upward movement the push lever unit 15 turns on the push lever plunger 52.

Next, contact between the push lever unit 15 and the housing 11 will described. To ensure that the push lever unit 15 is stable when performing this rapid reciprocation, the push lever 154 is constructed so as to butt against the housing 11 from below at two different locations from the push lever plunger 52 when moved to its uppermost position. These two locations on the housing 11 are called the first contact part 29A and the second contact part 29B.

Specifically, the first contact part 29A is a part of the valve guard 55 and is adjacent to both the rod 156 and the push lever plunger 52. The first contact part 29A is in a position to be contacted by the first protruding part 154A so that the first protruding part 154A contacts the rod 156 prior to contacting the first contact part 29A and turns on the push lever plunger 52 through the rod 156. In other words, the first protruding part 154A is configured to contact the first contact part 29A when the push lever unit 15 is disposed at the uppermost position.

The second contact part 29B is disposed near the nose tip 14A. The second contact part 29B constitutes a portion of the bottom surface of the housing 11 on the right side of the nose tip 14A so that the second contact part 29B is contacted by the second protruding part 154B. In other words, the second protruding part 154B is configured to contact the second contact part 29B when the push lever unit 15 is disposed at the uppermost position. The second protruding part 154B is constructed at a height for contacting the second contact part 29B as the push lever 154 moves upward after the first protruding part 154A contacts the first contact part 29A. Note that the actual time intervals between successive contacts are extremely short. In actuality, the push lever 154 may flex due to the large impact acting on the push lever 154 when the first protruding part 154A and second protruding part 154B contact the first contact part 29A and the second contact part 29B, respectively. However, even in such cases, the first protruding part 154A turns on the push lever plunger 52 before contacting the first contact part 29A.

Figure 4:
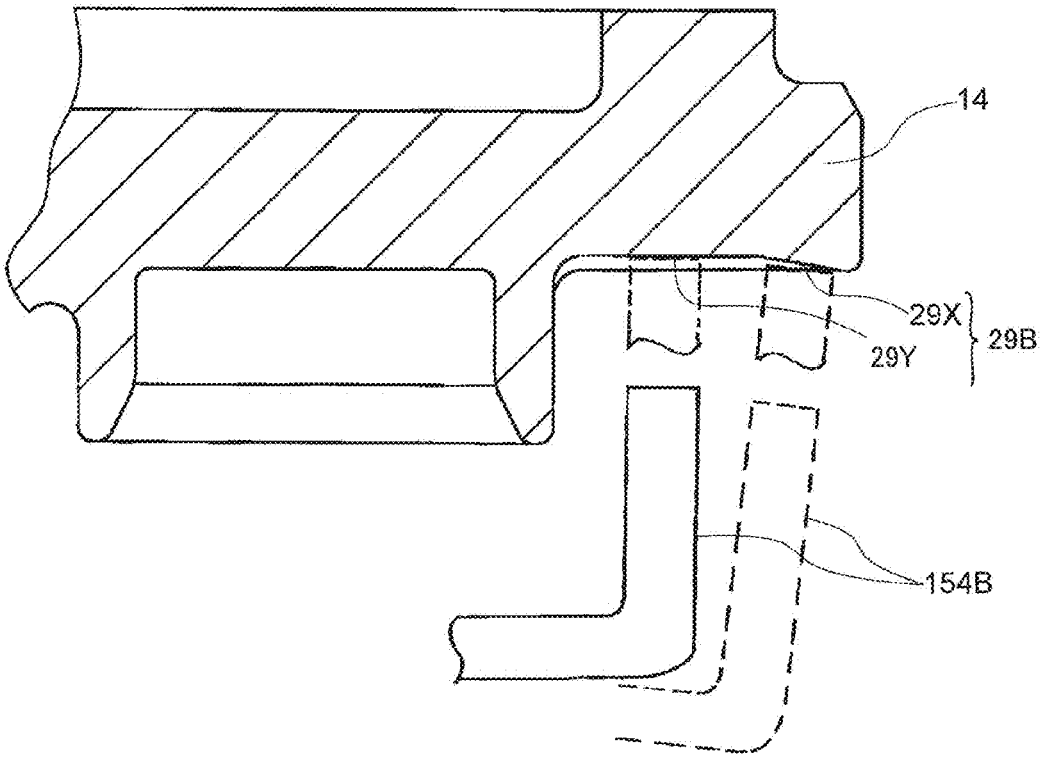
FIG. 4 is a cross-sectional view showing the shape of a contact part of the driving tool shown in FIG. 1.

FIG. 4 is a cross-sectional view showing an example of the second contact part 29B. The second contact part 29B is formed to bend downward on the outer side portion thereof in the horizontal direction. In other words, the bottom surface of the second contact part 29B includes a horizontal surface 29Y and a sloped surface 29X. The horizontal surface 29Y extends horizontally such that a normal to the horizontal surface 29Y is parallel to the moving direction of the push lever 154. The sloped surface 29X is positioned on a position away from the ejection channel 14C and protrudes downward. The sloped surface 29X has a normal is directed toward the nose 14.

Thus, the horizontal surface 29Y of the second contact part 29B is contacted by the second protruding part 154B when the push lever 154 is not deformed. The surface of the sloped surface 29X is formed continuously with the horizontal surface 29Y and slopes such that a normal to the sloped surface 29X is directed toward the nose tip 14A.

The structure of the push lever 154 and the housing 11 as described above ensures that the push lever unit 15 reliably operates the compressed air control unit 50 (turns on the push lever plunger 52), even when there is play in the push lever unit 15.

Next, the operation of the nail-driving tool 100 will be described.

With the above-described configuration, the compressed air is supplied from the storage chamber 18 into the upper chamber (the space above the piston 12) when the following two actions are performed together: (1) the operator places the lower end of the nose tip 14A in contact with a workpiece or the like, causing the push lever unit 15 to move upward and (2) the operator pulls the trigger lever 16. The operator pulls the trigger lever 16 with a finger to execute a nail-driving operation.

When the operations (1) and (2) are performed together, the compressed air control unit 50 performs an operation to introduce compressed air from the storage chamber 18 into the upper chamber. Together with the main valve 28, the storage chamber 18, cylinder 10, and the like serve as an example of a drive mechanism configured to drive the driver blade 13. As an alternative to a drive mechanism employing compressed air, a drive mechanism employing an electric motor or energy from the combustion of gas may be used as a drive mechanism.

If the compressed air control unit 50 is turned on while the cylinder 10 and piston 12 are in the initial state, the compressed air in the storage chamber 18 is introduced through the air channel 19 into the main valve chamber 20. The cylinder 10 urged upward by the spring 21 moves downward against this urging force from the pressure of the compressed air, and the piston 12 moves downward together with the cylinder 10. Through this operation, the exhaust valve 22 blocks passage between the space above the piston 12 (the upper chamber in the cylinder 10) and outside air, and the compressed air in the storage chamber 18 is introduced into the upper chamber. A portion of compressed air in the upper chamber is supplied into the return chamber 23 through the air holes 25 when the piston 12 moves below the height of the air holes 25.

Air in the space beneath the piston 12 (the lower chamber in the cylinder 10) flows into the return chamber 23 through the air channel 24. With this construction, the piston 12 and the driver blade 13 can move rapidly downward in the cylinder 10 to a bottom dead center in order to drive a nail. And then, the piston 12 contacts the piston bumper 27 after the piston 12 strikes the nail.

Subsequently, the above process is performed in reverse. The compressed air control unit 50 releases the compressed air from the main valve chamber 20, and the cylinder 10 moves back upward due to the elastic force of the spring 21. At the same time, the exhaust valve 22 is opened, returning the upper chamber in the cylinder 10 to atmospheric pressure. Further, since compressed air was accumulated in the return chamber 23 through the above operation, this compressed air passes from the return chamber 23 through the air channel 24 and applies pressure to the bottom of the piston 12, moving the piston 12 back toward its top dead center. In this way, the cylinder 10 returns to its upper position and the piston 12 returns to its top dead center (the initial state). Subsequently, the feeder 61 supplies the next nail to be driven from the magazine 60 into the ejection channel 14C formed in the nose 14. When the compressed air control unit 50 is once again turned on, this next nail will be driven out through the ejection hole 14B.

As described above, the compressed air control unit 50 only performs an operation to supply compressed air into the main valve chamber 20 when the following two actions are performed together: (1) the operator places the lower end of the nose tip 14A in contact with a workpiece or the like, causing the push lever unit 15 to move upward and (2) the operator pulls the trigger lever 16.

Effects of the present invention will be described while comparing the nail-driving tool 100 according to the embodiment with a nail-driving tool 200 serving as an example of a comparative art.

Figure 5:
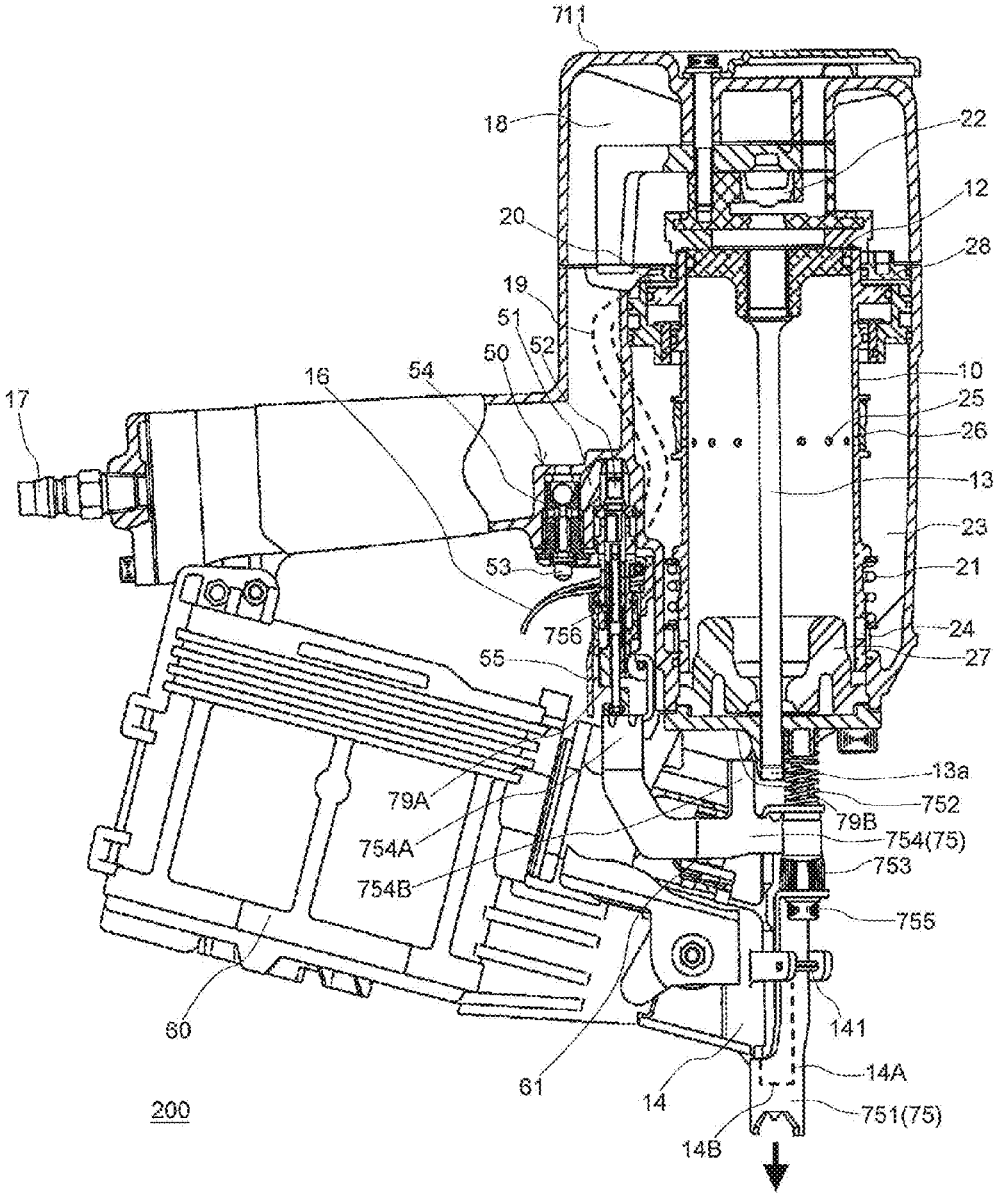
FIG. 5 is a cross-sectional view showing a comparative example of a nail-driving tool.
Figure 6:
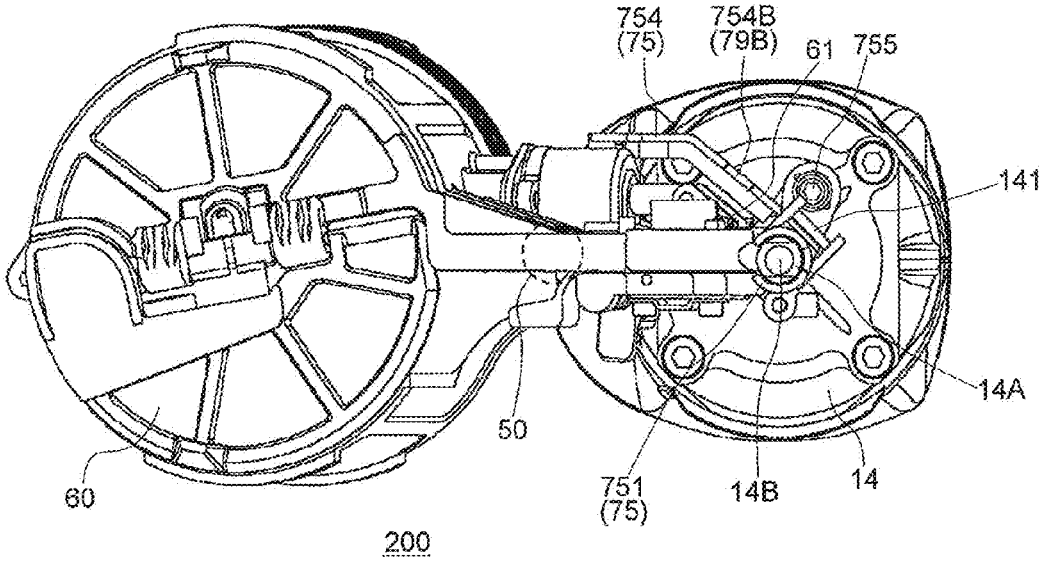
FIG. 6 is a bottom view of the nail-driving tool shown in FIG. 5.
Figure 7:
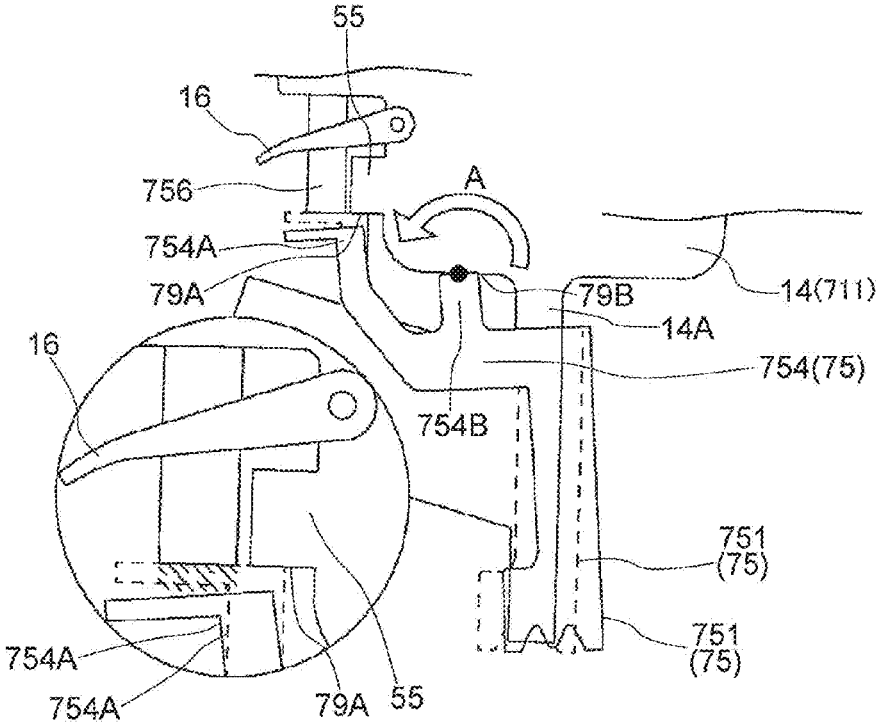
FIG. 7 schematically illustrates the structure of a push lever unit of the nail-driving tool shown in FIG. 5.

FIGS. 5-7 show the nail-driving tool 200. FIG. 5 is a cross-sectional view showing the structure of the nail-driving tool 200. FIG. 6 is a bottom view of the nail-driving tool 200 (a view of the side facing the workpiece into which a nail is to be driven).

The nail-driving tool 200 includes a housing 711 and a push lever unit 75 corresponding to the housing 11 and the push lever unit 15 of the embodiment. The push lever unit 75 includes a push lever body 751 and a push lever 754. The push lever 754 is provided with a first protruding part 754A, and a second protruding part 754B on the right side of the first protruding part 754A.

In the bottom view of FIG. 6, the compressed air control unit 50 is disposed on the left side in FIG. 5 and is hidden by the feeder 61 and the like. In the view of FIG. 6 the push lever 754 extends from its portion that is secured by a bolt 755 in a direction diagonally upward and leftward (on the near left side in FIG. 5). Near the left end of this extended portion, the push lever 754 extends downward in FIG. 6 in the region hidden by the feeder 61 (toward the far side in FIG. 5). The latter portion of the push lever 754 constitutes the first protruding part 754A. Therefore, the first protruding part 754A is positioned on the left side of the nose tip 14A in FIG. 6, while the second protruding part 754B is positioned above the nose tip 14A and compressed air control unit 50 in FIG. 6 (on the near side of these components in FIG. 5).

The first protruding part 754A first pushes up the rod 756 as the push lever 754 rises so that the rod 756 contacts and turns on the push lever plunger 52, and subsequently contacts the first contact part 79A. The second protruding part 754B is configured to contact the second contact part 79B thereafter.

FIG. 7 schematically shows the structure of the nail-driving tool 200 in the vicinity of the push lever unit 75 when the push lever unit 75 is operated. The push lever unit 75 is shown as an integral unit in this example.

In the nail-driving tool 200, the push lever body 751 is slidably disposed between the nose tip 14A and an anchoring pin 141 with minute gaps formed between neighboring parts. With this configuration, the push lever body 751 tends to have a looseness that allows the push lever body 751 to pivot as indicated by dashed lines in FIG. 7, tilting the entire push lever unit 75. Thus, the structure in FIG. 7 may allow the second protruding part 754B to contact the second contact part 79B before the first protruding part 754A contacts the push lever plunger 52. If a force acts on the push lever unit 75 to push the push lever body 751 upward at this time, the push lever unit 75 will rotate about the second protruding part 754B (second contact part 79B) in direction A shown in FIG. 7 (counterclockwise). This rotation inhibits the push lever unit 75 (first protruding part 754A) from pushing up and turning on the push lever plunger 52. While the push lever 754 is configured to contact two contact parts 79A and 79B in the nail-driving tool 200, the rotating phenomenon will occur regardless the number of contact parts.

Therefore, when the push lever unit 75 is tilted due to loose or worn of components of the push lever unit 75, the push lever unit 75 cannot properly turn on the push lever plunger 52 and the nail-driving tool 200 cannot function properly.

Next, the structure of the nail-driving tool 100 according to the embodiment will be described in relation to looseness in the push lever unit 15 that can lead the push lever unit 15 to tilt. When the push lever unit 15 is loose-fitting or wobbly, the vertical distance L (FIG. 1) between the top surface of the first protruding part 154A and the top surface of the second protruding part 154B will vary. Movement in the push lever unit 15 caused by such looseness is indicated using dashed lines in FIG. 3. As with the comparative example shown in FIG. 7, tilting of the push lever unit 15 caused by looseness can effectively decrease the distance L in the structure of the embodiment. When this occurs, it is possible that the second protruding part 154B may contact the second contact part 29B prior to the first protruding part 154A turning on the push lever plunger 52.

However, unlike the comparative example in FIG. 7, torque acts on the push lever unit 15 when a force is applied to the push lever body 151 for pushing the push lever body 151 upward, causing the push lever unit 15 to rotate about the second protruding part 154B (second contact part 29B) in direction B in FIG. 3 (clockwise). This rotation moves the first protruding part 154A upward, effectively increasing the distance L. Hence, the first protruding part 154A can push the push lever plunger 52 upward, turning on the push lever plunger 52, even though the push lever plunger 52 was not turned on when the second protruding part 154B contacted the second contact part 29B.

In other words, the push lever unit 15 can reliably turn on the push lever plunger 52, even when there is play in the push lever unit 15. As an alternate construction, the push lever unit 15 may be configured such that when the push lever unit 15 is rising, the first protruding part 154A first turns on the push lever plunger 52, the second protruding part 154B subsequently contacts the second contact part 29B, and lastly the first protruding part 154A contacts the first contact part 29A.

When using the push lever unit 75 shown in FIG. 7, for example, looseness, deformation, or the like occurring in the push lever unit 75 may cause the first protruding part 754A and the second protruding part 754B to contact the housing 711 in the incorrect order so that the push lever plunger 52 is not turned on properly, even if the operations for turning the push lever plunger 52 on are performed appropriately for the design of the push lever unit 75. In contrast, the push lever unit 15 of the embodiment reliably turns the push lever plunger 52 on, even when the first protruding part 154A and second protruding part 154B contact the housing 11 in the incorrect order due to looseness, deformation, or the like in the push lever unit 15.

As shown in FIG. 2, the compressed air control unit 50 of the nail-driving tool 100 is disposed at a position apart from the nose tip 14A in the direction toward the magazine 60 (the left side of the nose tip 14A along the horizontal direction in FIG. 2), as in the nail-driving tool 200. Therefore, in the nail-driving tool 100 of the embodiment, the compressed air control unit 50 (or the first protruding part 154A and the first contact part 29A), the nose tip 14A (or the ejection channel 14C formed therein), and the second protruding part 154B (or the second contact part 29B) are all aligned in a horizontal direction in FIG. 2. In other words, these same components are all disposed within the same approximate plane (a single vertical plane). Specifically, the lower end portion 151A of the push lever body 151, the first protruding portion 154A, and the second protruding portion 154B are disposed in a single imaginary plane. The compressed air control unit 50, the second protruding part 154A, and the ejection channel 14C are disposed within an imaginary plane extending in an approximate vertical direction. This arrangement achieves good balance for the push lever unit 15 when the push lever unit 15 is performing the above operations and suppresses uneven wear in the push lever unit 15, thereby suppressing the occurrence of play in the push lever unit 15. Focusing solely on the push lever unit 15, the lower end, top end, and contact parts of the push lever unit 15 all lie in the same plane.

By twisting the adjuster 153, the operator can adjust the vertical positional relationship between the push lever 154 and push lever body 151, thereby adjusting the depth in which nails are driven. However, the operations described above are performed identically, even when this positional relationship is changed.

The push lever 15 may become deformed through use over time, but the compressed air control unit 50 may also become deformed if the operator accidentally drops the nail-driving tool 100, for example. With the nail-driving tool 100, the operation to turn on the push lever plunger 52 can be reliably performed as illustrated in FIG. 3 even if the push lever 154 is tilted clockwise in FIG. 4 or the second protruding part 154B is deformed to the right in FIG. 4 (away from the nose tip 14A) as depicted with dashed lines. This is because the second contact part 29B has the horizontal surface 29Y and the sloped surface 29X. The second protruding part 154B contacts the sloped surface 29X when the second protruding part 154B is deformed or tilted. The operation illustrated in FIG. 3 is executed properly when the second protruding part 154B contacts the second contact part 29B from below along the normal of the horizontal surface 29Y, as depicted with solid lines in FIG. 4. In other words, the second protruding part 154B contacts the horizontal surface 29Y when the second protruding part 154B is properly disposed and not deformed. However, in the conventional art, the operation for turning the push lever plunger 52 on may not be executed properly because the second protruding part 154B may not contact the second contact part 29B.

Hence, the nail-driving tool 100 having the construction described above can suitably implement control of the compressed air control unit 50 even when the push lever unit 15 has been mounted with play or when the push lever unit 15 itself is deformed or is configured of a plurality of components that have looseness in their connections. Accordingly, the structure of the embodiment enhances the reliability of the nail-driving tool 100.

Modifications

While the invention has been described in detail with reference to the embodiment thereof, it would be apparent to those skilled in the art that various changes and modifications may be made therein without departing from the spirit of the invention.

In the structure of the embodiment described above, the first contact part 29A is provided on the valve guard 55 of the housing 11, and the second contact part 29B is provided on the housing 11. However, the first and second contact parts can be provided on any component fixed to the housing that poses no problem when the contact parts are contacted by the push lever. For example, the second contact part 29B may be provided on the nose 14.

While the driving tool 100 in the embodiment described above is powered by compressed air, the present invention may be applied to other types of driving tools, including an electric driving tool powered by an electric motor and a combustion-powered driving tool, provided that driving is performed when the push lever is in its upper position.

The driving tool 100 in the embodiment described above is a nail-driving tool for driving nails into a workpiece or the like. However, it should be apparent that the same effects described in the embodiment can be obtained by any driving tool for driving fasteners that uses a similar push lever unit and trigger lever.

In the embodiment, the push lever unit 15 has the sloped surface 29X. However, the housing 11 in the vicinity of the second contact part 29B may have another shape so that the operations can be performed appropriately even when such deformation occurs.

What is claimed is:

1. A driving tool comprising:

a housing having a nose provided with an ejection channel for guiding a fastener, the ejection channel being defined inside the nose and extending in a vertical direction;

a push lever unit configured to move between a lowermost position and an uppermost position in the vertical direction relative to the housing;

a compressed air control unit configured to control supply of compressed air and including a push lever plunger, the push lever plunger being configured to move upward and downward, the push lever plunger being moved upward by the push lever unit when the push lever unit is disposed at the uppermost position; and a driving unit configured to drive the fastener into a workpiece upon receiving the compressed air that has been supplied by the compressed air control unit;

wherein the housing includes a first contact part and a second contact part;

wherein the push lever unit includes a first protruding part and a second protruding part, the first protruding part being configured to contact the first contact part when the push lever unit is disposed at the uppermost position, the second protruding part being configured to contact the second contact part when the push lever unit is disposed at the uppermost position;

wherein the compressed air control unit, the second protruding part, and the ejection channel are disposed within an imaginary plane extending in an approximate vertical direction; and wherein the compressed air control unit is disposed on a side opposite to the second protruding part with respect to the ejection channel in a horizontal direction.

2. The driving tool according to claim 1, wherein the second protruding part is configured to contact the second contact part before the first protruding part contacts the first contact part while the push lever unit moves from the lowermost position to the uppermost position.

3. The driving tool according to claim 1, wherein the second contact part has a sloped surface, the sloped surface being positioned on a position away from the ejection channel and protruding downward.

4. The driving tool according to claim 1, wherein the second contact part has a sloped surface whose normal is directed toward the nose.

5. The driving tool according to claim 1, further comprising a trigger lever provided on the housing;

wherein, when the trigger lever is operated and the push lever plunger is pushed upward, the compressed air control unit supplies the compressed air and the driving unit drives the fastener into the workpiece using the compressed air that has been supplied.

6. A driving tool comprising:

a housing having a nose provided with an ejection channel for guiding a fastener, the ejection channel being disposed inside the nose and extending in a vertical direction, the nose having a lower end part;

a driver blade configured to reciprocate in the ejection channel and to drive the fastener;

a drive mechanism disposed in the housing and configured to drive the driver blade;

a trigger lever provided on the housing; and a push lever unit configured to move upward and downward in the vertical direction relative to the nose, wherein the push lever unit has:

a lower end portion disposed at a position closer to the lower end part of the nose than to the trigger lever; and an upper end portion disposed at a position closer to the trigger lever than to the lower end part of the nose; and a contact part configured to contact the housing, the contact part being disposed on a side opposite to the upper end portion with respect to the ejection channel in a horizontal direction;

wherein the lower end portion, the upper end portion, and the contact part are disposed in a single imaginary plane.

* * * * *